United States Patent [19]

Moore

[11] Patent Number: 4,612,993

[45] Date of Patent: Sep. 23, 1986

[54] RISER POSITION INDICATION APPARATUS

[75] Inventor: Boyd B. Moore, Houston, Tex.

[73] Assignee: Shell Oil Company, Houston, Tex.

[21] Appl. No.: 651,976

[22] Filed: Sep. 19, 1984

[51] Int. Cl.[4] ..... E21B 7/128; G08B 21/00

[52] U.S. Cl. ..... 166/335; 166/345; 166/355; 175/7; 340/666; 340/686

[58] Field of Search ..... 166/250, 335, 336, 345, 166/346, 355, 359, 367; 175/7; 340/666, 686; 254/900

[56] References Cited

U.S. PATENT DOCUMENTS 3,760,402 9/1973 Magerle et al. ..... 340/666 X 4,421,173 12/1983 Beakley ..... 166/336

OTHER PUBLICATIONS

*Composite Catalog of Oil Field Equipment and Services,* 34th Revision, vol. 3, 1980-1981, published by World Oil, Gulf Publishing Company, page 4865.

*Primary Examiner*—Stuart S. Levy

*Assistant Examiner*—David Werner

[57] ABSTRACT

Apparatus for use in drilling a well from a floating vessel by means of a riser, which connects the vessel's drilling equipment to a wellhead assembly adjacent to the ocean floor. The riser moves substantially vertically in relation to the vessel, as the vessel responds to wave action. The present riser position indication apparatus is comprised of a load cell and a chain attached beneath the load cell. Movement of the riser relative to the vessel alters the length of chain suspended from the load cell, thereby altering the signal from the cell. The signal can be subsequently calibrated to represent riser position.

7 Claims, 1 Drawing Figure

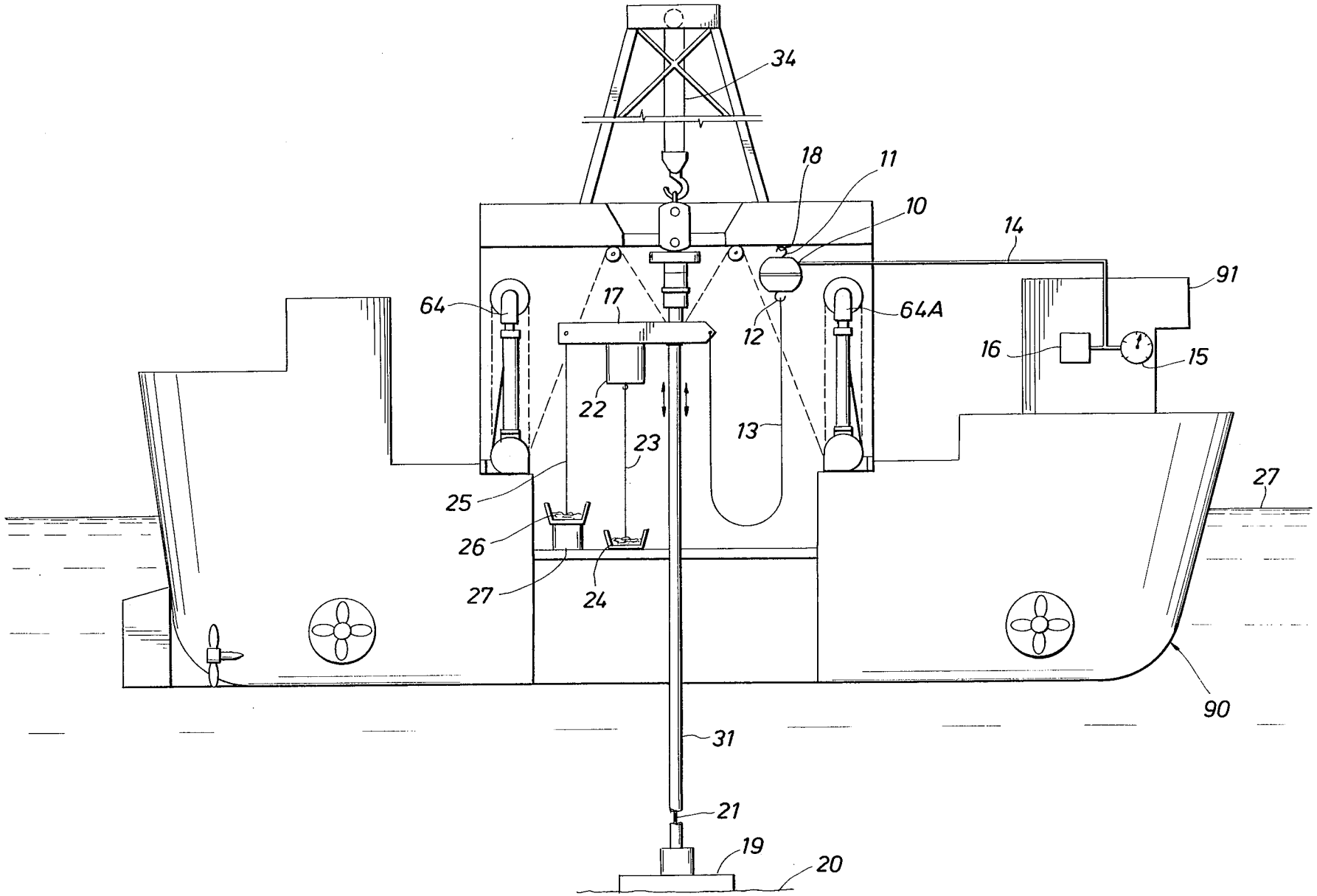
27
91
15
90
14
16
64A
10
11
18
34
12
13
20
19
21
31
23
17
22
24
25
26
27
64

RISER POSITION INDICATION APPARATUS

BACKGROUND OF THE INVENTION

1. Field of the Invention:

The present invention is directed to apparatus for drilling a well into earth formations lying below a body of water, wherein the wellhead equipment of the well is positioned below the surface of the water. The well is drilled from a floating drilling vessel, with a riser connecting the vessel drilling equipment to the wellhead assembly. The riser's upper elements move relative to the offshore vessel, as the vessel rises and falls on subsequent wave crests.

2. Description of the Prior Art:

An increasing amount of offshore deepwater exploratory well drilling is being conducted in an attempt to locate oil and gas reservoirs. These exploratory wells are generally drilled from floating vessels. As in any drilling operation, drilling fluid must be circulated through the drill bit in order to cool the bit and to carry away the cuttings. This drilling fluid is normally returned to the floating vessel by means of a large diameter pipe, known as a riser, which extends between the subsea wellhead assembly and the floating vessel. The lower end of this riser is connected to the wellhead assembly which is generally adjacent to the ocean floor, and the upper end usually extends through a centrally located hull opening of the floating vessel. A drillstring extends downward through the riser into earth formations lying below the body of water, and drilling fluids circulate downwardly through the drillstring, out through the drilling bit, and then upwardly through the annular space between the drillstring and riser, returning to the vessel.

As the water depths for these drilling operations continue to increase, the length of the riser and subsequently its unsupported weight also increases. Since the riser has the same structural buckling characteristics as a vertical column, riser structural failure may result if compressive stresses in the elements of the riser exceed the metallurgical limitations of the riser material. To avoid the possibility of this occurrence, riser tensioning systems are installed on board the vessel, which apply an upward force to the upper end of the riser, usually by means of cable and sheave mechanisms connected between the vessel and the upper elements of the riser.

Since the riser is secured at its lower end to the wellhead assembly, the floating vessel will move relative to the upper end of the riser due to wind, wave, and tide oscillations normally encountered in the marine environment.

This creates a problem because the stationary riser located within the hull opening of the oscillating vessel can contact and damage the vessel, unless it remains safely positioned within the hull opening. For this reason, motion compensating equipment incorporated with the riser tensioning system is used to steady the riser within the hull opening, and usually takes the form of hydraulically actuated cable and sheave mechanisms connectably engaged between the upper riser elements and the vessel structure. This equipment allows the vessel to heave, surge, and sway, without contacting the upper elements of the riser.

It is conventional practice to associate with such motion compensation equipment a riser position indicator which provides the operator with an indication of the relative positions of the offshore vessel and the riser, whereby the movements therebetween can be observed and/or recorded. In this manner, it can be determined, for example, whether or not any adjustment in the apparatus is required from time to time. In the past, the position indicators have suffered from a number of disadvantages. Not only were they relatively complicated, which in turn made them expensive and difficult to service or repair, but they were also inadequate in terms of the accuracy with which they could determine the relative position of the vessel relative to the riser. An apparatus as set forth in U.S. Pat. No. 4,421,173, issued Dec. 20, 1983, entitled "Motion Compensator with Improved Position Indicator", utilizes a flexible fluid filled tube mounted within the motion compensation apparatus structure itself. Movement of the motion compensation apparatus alters the elevated height of fluid above a differential pressure cell, thereby changing the fluid pressure sensed by the cell. A correspondingly altered signal is then generated by the differential pressure cell, as is well known to the art. Rupture of the fluid filled tube due to chafing of the tube on the compensation apparatus will cause an erroneous signal to be sent by this device. Maintenance performed on this apparatus during motion of the supporting motion compensation equipment may prove to be hazardous to operating personnel. Repair of this apparatus may therefore require suspension of drilling activities. An apparatus need be developed that provides proper position indication of the riser relative to the vessel and also allows easy repair and calibration of the device.

SUMMARY OF THE INVENTION

The present invention contemplates the incorporation of a relatively simple subsystem operatively engaged between the offshore vessel and the riser to serve as the position indicator. This subsystem includes a commercially available apparatus for producing a hydraulic signal which is a function of the weight of flexible weight element means such as a chain suspended from, or laying upon the signal apparatus. More specifically, it comprises a chain connected between the riser and the vessel, with a weight sensitive transmitter either carrying the suspended chain or placed below the suspended chain sections. As the riser and vessel move vertically relative to each other, the length of chain suspended from the vessel or riser also varies, thereby varying the weight applied to the weight transmitter. For example, if the weight transmitter is placed below the suspended chain, and the suspended chain moves downward, additional chain sections contacting the weight transmitter will increase the weight indication signal from the transmitter. The latter hydraulic signal can be translated into a visual readout of riser position by well known means.

Because of the simplicity of the position indicator apparatus, it is relatively inexpensive and easy to repair in situ. It can be located anywhere that a chain can be suspended from/to the riser or vessel. Operation of the motion compensation equipment need not be secured to effect its repair. This apparatus can safely operate in an explosive environment, since no electrical current is required for its operation.

Accordingly, it is a principal object of the present invention to provide an offshore vessel which carries a riser therefrom with an improved riser position indicator means.

Another object of the present invention is to provide a riser position indication means which is relatively simple and inexpensive, yet safe, versatile, and highly accurate.

Still other objects, features, and advantages of the present invention will be made apparent by the following detailed description of the preferred embodiments, the drawing, and the claims.

BRIEF DESCRIPTION OF THE DRAWINGS

FIG. 1 is a schematic representation of an underwater drilling operation in which a riser, according to the present invention, is shown connected between a floating vessel and a subsea wellhead assembly.

DETAILED DESCRIPTION OF THE DRAWINGS

As can be seen in FIG. 1, an offshore vessel 90 is floating in a body of water 27. A riser 31 which is supported by the vessel 90 by means of riser motion compensating apparatus 64,64A, is shown vertically suspended downward to a wellhead equipment 19 assembly which is located upon the ocean floor 20. The riser 31 contains a drillstring 21. The drillstring is supported by the drillstring and riser lifting mechanism 34.

As the vessel 90 rises and falls on waves in the body of water 27, the motion compensation apparatus 64,64A in this particular embodiment, comprised of a piston and cylinder arrangement well known to the art, compensates for this movement by applying a counter-acting force to the riser 31 as the vessel heaves and falls, in order to apply a relatively constant tension load to the riser 31 during the vertical movement of the vessel 90. As the vessel 90 continues its vertical oscillation, the riser 31 moves vertically relative to the offshore vessel 90. Adjustments in the motion compensation apparatus 64,64A compensation rate can be made after observation and/or measurement of the rate of change of the riser's 31 movement relative to the vessel's 90 displacement. Movement of the riser 31 relative to the vessel 90 can be measured accurately by use of the riser positioning indication apparatus in the preferred embodiment, comprising a load cell A 10, and chain A 13.

In the preferred embodiment, weight transmitter signal means such as a load cell A 10 is connected to vessel connection means such as vessel connection bracket 18 by means of an upper hook 11. A hydraulic hose 14 leaves the load cell A 10 and is routed to a pressure gauge 15 well known to the art located within the vessel control room 91. A lower hook 12 on the lower portion of the load cell A 10 supports the flexible weight means such as a chain A 13 in the preferred embodiment which forms a loop and subsequently connects to riser connection means such as the riser connection bracket 17. The load cell A 10, such as a Martin Decker Model CP000-E-403 senses the weight of the chain A 13 suspended directly underneath the lower hook 12. In operation, as the riser 31 falls vertically downward with respect to the vessel 90, the length of chain A 13 suspended from the lower hook 12 increases, which causes an increase in the weight on load cell A 10. This increased weight sends a correspondingly increased hydraulic pressure signal through the hydraulic hose 14 to the pressure gauge 15, as is well known to the art. When the riser 31 rises relative to the vessel 90, the length of chain suspended from load cell A 10 decreases, which decreases the indication on pressure gauge 15. As can be readily observed, the entire apparatus is easy to install, requires little maintenance, and can be calibrated with a minimum amount of visual observation of the riser position 31 relative to the vessel 90. For example, calibration can be performed by notation of the dial reading on the pressure gauge 15 as the riser 31 moves to a certain position relative to the vessel 90. Subsequent riser 31 movement to that position will cause similar dial readings of the pressure gauge 15, so that the gauge 15 may be used to determine subsequent riser 31 positions. The hydraulic signal indicated on pressure gauge 15 may also be converted to an electrical signal by connection of an electrical transmitter 16 to the hydraulic hose 14 by means well known to the art.

Alternative embodiments of the present invention are also shown connected to the riser connection bracket 17. For instance, load cell B 22 may be connected to the riser connection bracket 17 and a chain B 23, suspended from the load cell B 22. Excess chain is collected in chain B container 24. In operation, as the riser 31 moves vertically downward in relation to the vessel 90, the length of chain B 23 suspended from load cell B 22 decreases, which decreases the weight on load cell B 22, which causes a reduction in the weight signal sent from load cell B 22.

In another alternative embodiment, load cell C 27 is shown located beneath chain C container 26, which collects and supports chain C 25. As can be seen, chain C 25 is attached at its upper elements to the riser connection bracket 17. In operation, when the riser 31 falls relative to the vessel 90, the amount of chain stored in the chain C container 26 increases, which causes an increase in the weight on load cell C 27, which thereby increases its output signal to an appropriate indication device.

It is recognized that different types of chain and load cell combinations may be used to achieve the effect of monitoring the movement of the riser 31 relative to the vessel 90. Since wind may be a factor in distortion of a light chain applied in the system, it is recommended that a heavy chain system be installed between the riser connection bracket 17 and the lower hook 12 of load cell A 10, in the preferred embodiment. Cable or wire rope may also be used in an alternative embodiment to perform the same function as the chain in the preferred embodiment.

Many other variations and modifications may be made in the apparatus and techniques hereinbefore described, both by those having experience in this technology, without departing from the concept of the present invention. Accordingly, it should be clearly understood that the apparatus and methods depicted in the accompanying drawings and referred to in the foregoing description are illustrative only and are not intended as limitations on the scope of the invention.

I claim as my invention:

1. Riser Position Indication Apparatus for disposition between an offshore vessel and a riser, said riser being moveable with respect to said offshore vessel, said riser position indication apparatus comprising:

vessel connection means operatively engaged with said vessel to secure said riser position indication apparatus to said vessel, riser connection means operatively engaged with said riser to secure said riser position indication apparatus to said riser, flexible weight means having one end connected to one of said connection means and the other end operatively engaged with the other of said connection means, weight signal transmitter means associated with at least one end of said flexible weight means and operative to produce a continuous output signal which varies as a function of the weight of said weight means suspended from one end of said connection means.

2. The apparatus of claim 1 wherein said weight signal transmitter means signal is hydraulic.

3. The apparatus of claim 2 wherein said weight signal transmitter means further includes electrical readout means operably connected to said weight signal transmitter means for producing a readout comparable to said hydraulic signal.

4. The apparatus of claim 1 wherein said weight signal transmitter means further includes attachment hook means to attach said flexible weight means to said weight signal transmitter means.

5. The apparatus of claim 1 wherein said weight signal transmitter means further includes attachment hook means to attach said signal transmitter to said vessel connection means.

6. The apparatus of claim 1 wherein said flexible weight means comprises a chain.

7. The apparatus of claim 1 wherein said flexible weight means comprises a cable.

* * * * *